US005830113A

United States Patent [19]

Coody et al.

[11] Patent Number: 5,830,113

[45] Date of Patent: Nov. 3, 1998

[54] FOLDABLE TREADMILL AND BENCH APPARATUS AND METHOD

[75] Inventors: Bruce F. Coody, Auburn; Greg Harris, Opelika, both of Ala.; Todd S. Cantrell, Wichita, Kans.

[73] Assignee: FF Acquisition Corp., West Point, Miss.

[21] Appl. No.: 749,773

[22] Filed: Nov. 20, 1996

Related U.S. Application Data

[63] Continuation-in-part of Ser. No. 647,620, May 13, 1996.

[51] Int. Cl.[6] ..... A63B 22/02

[52] U.S. Cl. ..... 482/54

[58] Field of Search ..... 482/54, 51

[56] References Cited

U.S. PATENT DOCUMENTS

| | | |
|---|---|---|
| D. 207,541 | 5/1967 | Hesen . |
| D. 211,801 | 7/1968 | Quinton . |
| D. 217,173 | 4/1970 | Frasier . |

(List continued on next page.)

FOREIGN PATENT DOCUMENTS

| | | |
|---|---|---|
| 0 095 226 | 3/1983 | European Pat. Off. . |
| 1468272 | 2/1966 | France . |
| 71.31842 | 4/1973 | France . |
| 83466 | 8/1908 | Germany . |
| 2 215 119 | 11/1973 | Germany . |
| 2 225 342 | 12/1973 | Germany . |
| 24 08 052 | 8/1975 | Germany . |
| 51-10842 | 3/1976 | Japan . |
| 56-56358 | 5/1981 | Japan . |
| 56-150562 | of 1989 | Japan . |
| 825122 | 7/1977 | U.S.S.R. . |
| 1248615 A1 | 7/1986 | U.S.S.R. . |
| 1169148 | 10/1969 | United Kingdom . |
| 1326263 | 8/1973 | United Kingdom . |
| 1505702 | 3/1978 | United Kingdom . |
| 2 120 560 | 12/1983 | United Kingdom . |
| WO 80/00099 | 6/1981 | WIPO . |

OTHER PUBLICATIONS

Advertisement for Sportmart Health & Fitness for the "The Step" (Sportmart Health & Fitness, Jan. 23, 1993, 1 pg.).

Advertisement for "The Step" and The Step II (Sears The Great American Wish Book 1991, 2 pp.).

Advertising for "Introducing The New Step Rebook™ Platform" Designed to Meet the Demands of the Health Club Industry, (©1993 Reebook International Ltd., 1 pg.).

Advertisement for "Step II" (Winter 1995 Home Fitness Buyers Guide, p. 69).

Voit Adertisement "Body Jack" (Damark, Nov. 1–4, 1994, 1 pg.).

Voit Advertisement "Gravity Rider" with enlarged photocopy (Damark, Jul. 28–Aug. 1, 1994, 2 pp.).

Voit Adertisement "Gravity Ridger" (Damark, Jul. 28, 1994, 2 pp.).

Owner's Manual for "Pro–Form® Cross Walk® advantage" (©1994 ICON Health & Fitness, Inc., 18 pp.).

Copy of brochure entitled "Technology For Total Fitness Genesis 1000™" (Genesis, Inc., 1985, 6 pp. ).

Copy of brochure entitled "Technology For Total Fitness Genesis 2000™" (Genesis, Inc., 1985) (pp. P004577–P004582, 6 pp.).

Copy of brochure entitled "Technology For Total Fitness Genesis 3000™" (Genesis, Inc. 1985), (pp. P004593–P004594 & P004589–P004592, 6 pp.).

(List continued on next page.)

*Primary Examiner*—Lynne A. Reichard

*Attorney, Agent, or Firm*—Brinks Hofer Gilson & Lione

[57] ABSTRACT

Treadmill apparatus includes an up-right support, a track bed, and a bench which may be attached to or folded down from the underside of the treadmill. The treadmill apparatus may further include exercise bands that may be mounted to the underside of the treadmill or to the support.

25 Claims, 7 Drawing Sheets

U.S. PATENT DOCUMENTS

| | | |
|---|---|---|
| D. 270,555 | 9/1983 | Ogden . |
| D. 277,304 | 1/1985 | Smith et al. . |
| D. 283,239 | 4/1986 | Smith et al. . |
| 284,294 | 9/1883 | Graves . |
| D. 284,597 | 7/1986 | Smith et al. . |
| D. 304,849 | 11/1989 | Watterson . |
| D. 306,468 | 3/1990 | Watterson . |
| D. 306,891 | 3/1990 | Watterson . |
| D. 316,124 | 4/1991 | Dalebout et al. . |
| 321,388 | 6/1885 | Ruebsam . |
| D. 323,009 | 1/1992 | Dalebout et al. . |
| D. 323,198 | 1/1992 | Dalebout et al. . |
| D. 323,199 | 1/1992 | Dalebout et al. . |
| D. 344,112 | 2/1994 | Smith . |
| D. 344,557 | 2/1994 | Ashby . |
| D. 348,493 | 7/1994 | Ashby . |
| D. 348,494 | 7/1994 | Ashby . |
| D. 351,202 | 10/1994 | Bingham . |
| D. 351,633 | 10/1994 | Bingham . |
| D. 356,128 | 3/1995 | Smith et al. . |
| D. 358,437 | 5/1995 | Wang et al. . |
| D. 361,806 | 8/1995 | Bartlett . |
| D. 361,807 | 8/1995 | Bartlett . |
| 659,216 | 10/1900 | Durham . |
| 663,486 | 12/1900 | Boren . |
| 881,521 | 3/1908 | Wilson . |
| 931,394 | 8/1909 | Day . |
| 1,020,777 | 3/1912 | Peterson . |
| 1,064,968 | 6/1913 | Hagen . |
| 1,082,940 | 12/1913 | Flora . |
| 1,715,870 | 6/1929 | Spain . |
| 1,778,635 | 10/1930 | Heisler . |
| 1,824,406 | 9/1931 | Petersime . |
| 1,850,530 | 3/1932 | Brown . |
| 1,902,694 | 3/1933 | Edwards . |
| 1,928,089 | 9/1933 | Blickman . |
| 1,973,945 | 9/1934 | Chavin et al. . |
| 2,145,940 | 2/1939 | Marlowe . |
| 2,440,644 | 4/1948 | Powell . |
| 2,470,544 | 5/1949 | Bell . |
| 2,642,288 | 6/1953 | Bell . |
| 2,714,507 | 8/1955 | Goodrich . |
| 2,855,200 | 10/1958 | Blickman . |
| 2,874,971 | 2/1959 | Devery . |
| 2,924,456 | 2/1960 | Miller . |
| 3,127,171 | 3/1964 | Noland et al. . |
| 3,378,259 | 4/1968 | Kupchinski . |
| 3,446,503 | 5/1969 | Lawton . |
| 3,586,322 | 6/1971 | Kverneland . |
| 3,589,715 | 6/1971 | Mark . |
| 3,606,320 | 9/1971 | Erwin, Jr. . |
| 3,614,097 | 10/1971 | Blickman . |
| 3,642,279 | 2/1972 | Cutter . |
| 3,650,529 | 3/1972 | Salm et al. . |
| 3,659,845 | 5/1972 | Quinton . |
| 3,709,487 | 1/1973 | Walker . |
| 3,731,917 | 5/1973 | Townsend . |
| 3,738,649 | 6/1973 | Miller . |
| 3,741,538 | 6/1973 | Lewis et al. . |
| 3,751,033 | 8/1973 | Rosenthal . |
| 3,826,491 | 7/1974 | Elder . |
| 3,858,938 | 1/1975 | Kristensson et al. . |
| 3,874,657 | 4/1975 | Niebojewski . |
| 3,892,404 | 7/1975 | Martucci . |
| 3,918,710 | 11/1975 | Niebojewski . |
| 3,963,101 | 6/1976 | Stadelmann et al. . |
| 3,966,182 | 6/1976 | Stadelmann et al. . |
| 3,976,058 | 8/1976 | Tidwell . |
| 4,026,545 | 5/1977 | Schönenberger . |
| 4,043,552 | 8/1977 | Kerkonian . |
| 4,066,257 | 1/1978 | Moller . |
| 4,093,196 | 6/1978 | Bauer . |
| 4,170,351 | 10/1979 | Ozbey et al. . |
| 4,176,836 | 12/1979 | Coyle . |
| 4,188,030 | 2/1980 | Hooper . |
| 4,248,476 | 2/1981 | Phelps . |
| 4,300,760 | 11/1981 | Bobroff . |
| 4,300,761 | 11/1981 | Howard . |
| 4,344,616 | 8/1982 | Ogden . |
| 4,374,587 | 2/1983 | Ogden . |
| 4,383,714 | 5/1983 | Ishida . |
| 4,406,451 | 9/1983 | Gaetano . |
| 4,422,635 | 12/1983 | Herod et al. . |
| 4,445,683 | 5/1984 | Ogden . |
| 4,452,448 | 6/1984 | Ausherman . |
| 4,502,679 | 3/1985 | De Lorenzo . |
| 4,544,153 | 10/1985 | Babcock . |
| 4,572,500 | 2/1986 | Weiss . |
| 4,576,352 | 3/1986 | Ogden . |
| 4,591,147 | 5/1986 | Smith et al. . |
| 4,600,189 | 7/1986 | Olschansky et al. . |
| 4,625,962 | 12/1986 | Street . |
| 4,635,927 | 1/1987 | Shu . |
| 4,635,928 | 1/1987 | Ogden et al. . |
| 4,637,608 | 1/1987 | Owens et al. . |
| 4,641,833 | 2/1987 | Trethewey . |
| 4,643,418 | 2/1987 | Bart . |
| 4,664,371 | 5/1987 | Viander . |
| 4,664,646 | 5/1987 | Rorabaugh . |
| 4,679,787 | 7/1987 | Guilbault . |
| 4,682,750 | 7/1987 | Rudolph et al. . |
| 4,684,126 | 8/1987 | Dalebout et al. . |
| 4,709,918 | 12/1987 | Grinblat . |
| 4,729,558 | 3/1988 | Kuo . |
| 4,751,755 | 6/1988 | Carey, Jr. et al. . |
| 4,757,987 | 7/1988 | Allemand . |
| 4,759,540 | 7/1988 | Yu et al. . |
| 4,776,582 | 10/1988 | Ramhorst . |
| 4,792,134 | 12/1988 | Chen . |
| 4,805,901 | 2/1989 | Kulick . |
| 4,809,976 | 3/1989 | Berger . |
| 4,813,743 | 3/1989 | Mizelle . |
| 4,817,939 | 4/1989 | Augspurger et al. . |
| 4,826,153 | 5/1989 | Schalip . |
| 4,844,449 | 7/1989 | Truslaske . |
| 4,886,266 | 12/1989 | Trulaske . |
| 4,905,330 | 3/1990 | Jacobs . |
| 4,913,396 | 4/1990 | Dalebout et al. . |
| 4,913,423 | 4/1990 | Farran et al. . |
| 4,921,247 | 5/1990 | Sterling . |
| 4,938,473 | 7/1990 | Lee et al. . |
| 4,974,831 | 12/1990 | Dunham . |
| 4,984,810 | 1/1991 | Stearns et al. . |
| 4,998,725 | 3/1991 | Watterson et al. . |
| 5,002,271 | 3/1991 | Gonzales . |
| 5,007,630 | 4/1991 | Real et al. . |
| 5,029,801 | 7/1991 | Dalebout et al. . |
| 5,058,881 | 10/1991 | Measom . |
| 5,072,928 | 12/1991 | Stearns et al. ..... 482/54 |
| 5,085,426 | 2/1992 | Wanzer et al. . |
| 5,102,380 | 4/1992 | Jacobson et al. . |
| 5,109,778 | 5/1992 | Berkowitz et al. . |
| 5,110,117 | 5/1992 | Fisher et al. . |
| 5,156,650 | 10/1992 | Bals . |
| 5,163,885 | 11/1992 | Wanzer et al. . |
| 5,178,599 | 1/1993 | Scott . |
| 5,184,988 | 2/1993 | Dunham . |
| 5,192,255 | 3/1993 | Dalebout et al. . |
| 5,207,622 | 5/1993 | Wilkinson et al. . |
| 5,207,628 | 5/1993 | Graham . |
| 5,232,426 | 8/1993 | Van Straaten . |
| 5,254,067 | 10/1993 | Habing et al. . |

| | | | |
|---|---|---|---|
| 5,282,776 | 2/1994 | Dalebout . | |
| 5,299,992 | 4/1994 | Wilkinson . | |
| 5,299,997 | 4/1994 | Chen . | |
| 5,306,218 | 4/1994 | Chen . | |
| 5,330,404 | 7/1994 | Lopeteguy et al. . | |
| 5,336,146 | 8/1994 | Piaget et al. . | |
| 5,338,277 | 8/1994 | Yang . | |
| 5,342,269 | 8/1994 | Huang et al. . | |
| 5,344,372 | 9/1994 | Hung . | |
| 5,352,167 | 10/1994 | Ulicny . | |
| 5,352,169 | 10/1994 | Eschenbach . | |
| 5,356,357 | 10/1994 | Wang et al. . | |
| 5,366,428 | 11/1994 | Liao . | |
| 5,370,594 | 12/1994 | Grinblat . | |
| 5,372,559 | 12/1994 | Dalebout et al. . | |
| 5,378,212 | 1/1995 | Pin-Kuo . | |
| 5,407,408 | 4/1995 | Wilkinson | 482/54 |
| 5,421,795 | 6/1995 | Chen . | |
| 5,423,731 | 6/1995 | Chen . | |
| 5,429,568 | 7/1995 | Chen . | |
| 5,441,467 | 8/1995 | Stevens . | |
| 5,447,479 | 9/1995 | Gvoich . | |
| 5,453,066 | 9/1995 | Richter, Jr. . | |
| 5,456,644 | 10/1995 | Hecox et al. . | |
| 5,464,378 | 11/1995 | Yu . | |
| 5,476,431 | 12/1995 | Wilkinson et al. | 482/54 |
| 5,518,471 | 5/1996 | Hettinger et al. . | |
| 5,607,375 | 3/1997 | Dalebout et al. . | |
| 5,662,557 | 9/1997 | Watterson et al. . | |
| 5,669,857 | 9/1997 | Watterson et al. . | |
| 5,672,140 | 9/1997 | Watterson et al. . | |
| 5,674,156 | 10/1997 | Watterson et al. . | |
| 5,674,453 | 10/1997 | Watterson et al. . | |
| 5,676,624 | 10/1997 | Watterson et al. . | |
| 5,683,332 | 11/1997 | Watterson et al. . | |
| 5,702,325 | 12/1997 | Watterson et al. . | |
| 5,704,879 | 1/1998 | Watterson et al. . | |
| 5,718,657 | 2/1998 | Dalebout et al. . | |
| B1 4,913,396 | 8/1994 | Dalebout et al. . | |
| B2 4,913,396 | 5/1993 | Dalebout et al. . | |
| B3 4,913,396 | 6/1995 | Dalebout et al. . | |

OTHER PUBLICATIONS

Copy of brochure entitled "Technology For Total Fitness Genesis 4000™", (Genesis, Inc., 1985), (pp. P004583–P004588, 6 pp.).

Copy of brochure for Genesis 1000™, Technology for Total Fitness entitled "The Optimum Performance Home Fitness Center" (©Genesis, Inc. Sep. 1985, 1 pg.).

Copy of brochure for Genesis 2000™, Technology for Total Fitness entitled "The Ultimated in Home Exercise Equipment" (©Genesis, Inc. Sep. 1985, 2 pp.).

Copy of brochure for Genesis 3000™, Technology for Total Fitness entitled "The Dynamic Answer to Home Fitness and Health" (©Genesis, Inc. Sep. 1985, 1 pg.).

Copy of brochure for Genesis 4000™, Technology for Total Fitness entitled "The Modern Approach to Home Fitness and Health" (©Genesis, Inc. Sep. 1985, 2 pp.).

Copy of brochure for Genesis 5000™, Technology for Total Fitness entitled "The Advancement In Home Fitness and Convenience" (©Genesis, Inc. 1985, 1 pg.).

Copy of brochure for Genesis 6000™, Technology for Total Fitness entitled "Maximum Workout in Minimal Space" (©Genesis, Inc. 1985, 1 pg.).

Copy of brochure for Vitamaster. © 1988 Product Line entitled "Vitamaster®".

Copy of brochure for Roamaster Fitness Equipment 1989 (Roadmaster Corporation 1989, 6 pp.).

WESLO color photos 1995/1996 Treadmill (4 sheets of colored photos).

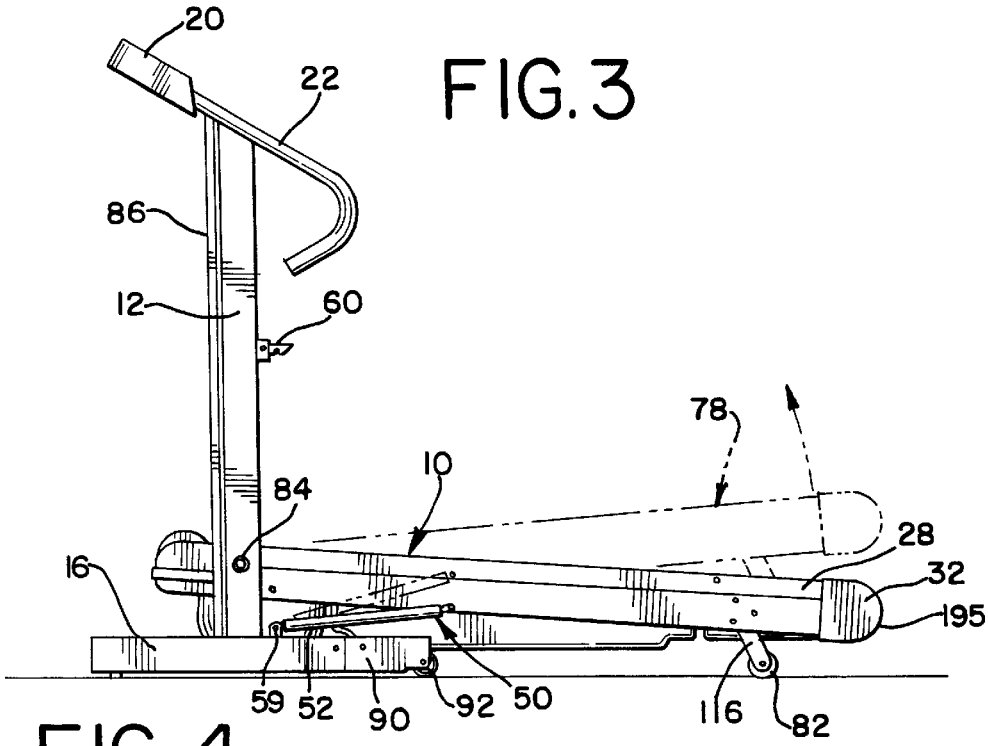
FIG. 3
FIG. 4
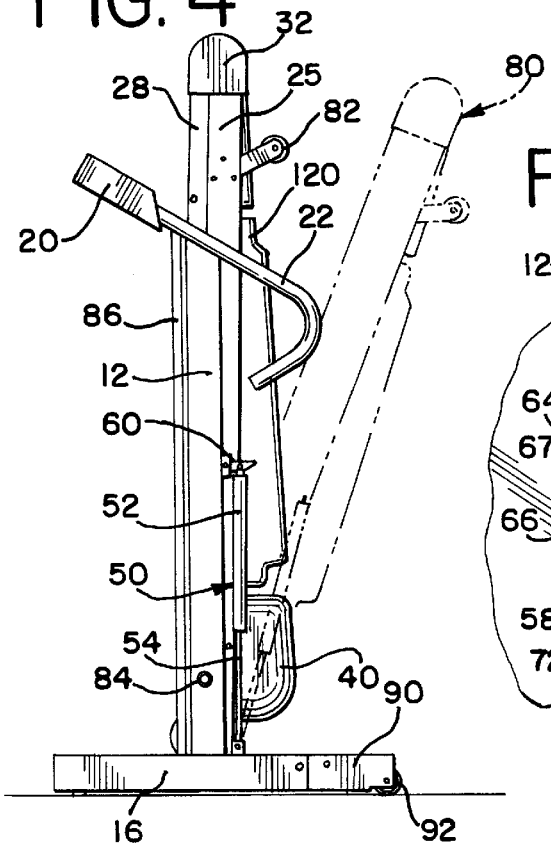
FIG. 5
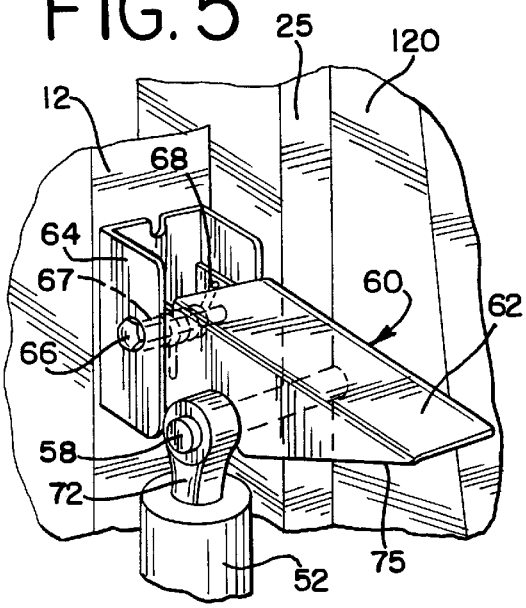

FOLDABLE TREADMILL AND BENCH APPARATUS AND METHOD

RELATED APPLICATIONS

This application is a continuation-in-part application of Ser. No. 08/647,620, filed May 13, 1996, which is incorporated herein by reference.

TECHNICAL FIELD

The invention relates to improved treadmill apparatus and method of operating the same. In particular, this invention relates to a treadmill design which allows the track bed to be folded to an up-right position when not in use, and a bench apparatus which may be attached to or fold down from the underside of the track bed. Exercise bands are attached to the treadmill to allow a user to perform upper body exercises.

BACKGROUND OF THE INVENTION

Treadmills are a well-known class of exercising machines which are typically difficult to store because of their awkward shape and size. In general, treadmills include a track bed, and a support structure with handle bars. Most treadmills also include a console. Various designs for folding and collapsing treadmills have been or are in present use. Many of these designs are for non-powered treadmills. For example, U.S. Pat. No. 931,394 was an early design of a non-powered foldable treadmill, which discloses a track bed hinged at its forward end to support legs. The simplicity of this design is not easily translatable to a heavier modern treadmill.

One problem with folding a modern treadmill is that the track bed is generally heavier because of various features, including a motor, drive and retractable wheel mechanism. This added weight turns a raised track bed into a hazard. If released from the up-right position, the track bed will rapidly fall and could injure a person. The heavy track bed is also difficult to manually lift to the up-right position and may cause back strain or other injury. It would be desirable to have a track bed that would have an assist device that would prevent the up-right track bed from rapidly falling. Also, it would be desirable for the assist device to reduce the effective weight of the track bed, thus allowing a person to easily lift the track bed to the folded position with minimal effort.

Another problem associated with foldable treadmills is the latch or lock system used to hold the track bed in the up-right position. Once unlatched, the treadmill becomes dangerous if released by the user. It would be desirable to have a lock system that would automatically lock when the track bed is at or near the up-right position.

Another problem with treadmills in general, is that they are a rather large and expensive piece of exercise equipment that only allows for one specific exercise. It would be desirable to have a foldable treadmill that would provide the user with additional exercise apparatus to work major upper body muscle groups.

SUMMARY OF THE INVENTION

One aspect of the invention provides for treadmill apparatus including an up-right support, a track bed, and a bench attached to the underside of the track bed. The bench may be removably attached to the track bed. The bench may also be rotatably attached to the track bed. The underside of the track bed may also include a recessed area for receiving the bench. And, a leg may be foldably attached to the underside of the bench to provide additional support. The apparatus may also include at least one, and preferably two exercise bands mounted to the underside of the track bed. Alternatively, the bands may be attached to the support, and preferably to a base portion of the support. A back support may also be attached or formed in the underside of the track bed. The apparatus may further include a gas shock attached to the support and to the track bed.

Another aspect of the invention provides for a method of operating a treadmill apparatus. A folding treadmill with the track bed in the up-right position and with a bench folded into the underside of the track bed is provided. The bench which is rotatably connected to the track bed is then folded down. Exercise bands mounted to a base support may also be provided. The bands may then be pulled while the user is positioned on the bench.

Another aspect of the invention provides for a method of operating treadmill apparatus. A folding treadmill with the track bed in the up-right position and a bench are provided. The bench may then be attached to a receiver portion formed in the underside of the track bed. Exercise bands may be mounted to the underside of the treadmill. The user may then pull the exercise bands while positioned on the bench.

Another aspect of the invention provides treadmill apparatus including a support, a track bed rotatably attached to the support, and at least one exercise band attached to the support. A bench may be attached to the treadmill.

Another aspect of the invention includes a treadmill apparatus including a support, a track bed rotatably attached to the support, and at least one exercise band attached to the underside of the track bed. The treadmill may further include a bench attached to the treadmill. And, the treadmill may also include a back rest attached to the track bed.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

BRIEF DESCRIPTION OF THE DRAWINGS

FIG. 3 is a side view of a preferred embodiment of the invention with the track bed also shown slightly raised in phantom.

FIG. 4 is a side view of a preferred embodiment of the invention in the up-right position with the track bed shown partially lowered in phantom.

FIG. 5 is an enlarged cut away perspective view of an embodiment of the latch in the locked position.

DETAILED DESCRIPTION OF THE PRESENTLY PREFERRED EMBODIMENTS

Figure 2:
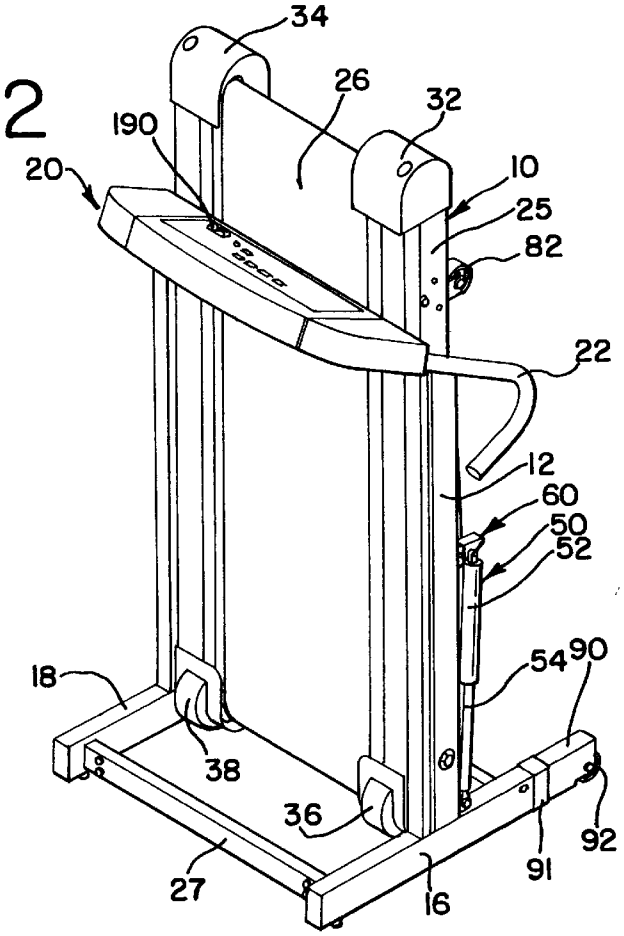
FIG. 2 is a perspective view of a preferred embodiment of the invention in the up-right position.
Figure 1:
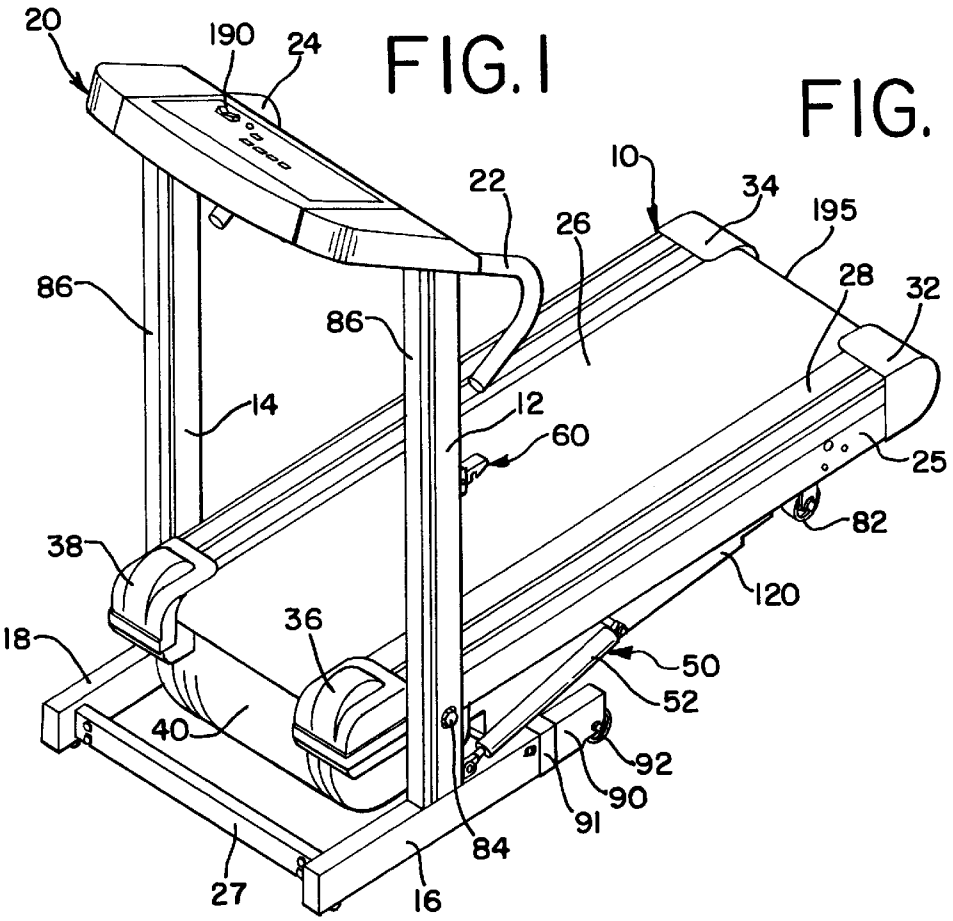
FIG. 1 is a perspective view of a preferred embodiment of the invention with the track bed in an operation or down position.

Referring to FIGS. 1–4, a preferred embodiment of the treadmill is shown having a track bed 10, up-right support legs 12, 14, base supports 16, 18 and console 20. Extending from an upper portion of the support legs 12, 14 are handrails 22, 24. Track bed 10 includes frame 25, tread belt 26, side rails 28, 30, rear end caps 32, 34 and front end caps 36, 38. A motor housing 40, and frame cover 120 are attached to the underside of the frame 25. The end caps 32, 34, 36, 38, motor housing 40, and frame cover 120 are preferable made of a rigid plastic. The frame 25 is preferably made of rectangular steel tubing.

Figure 8:
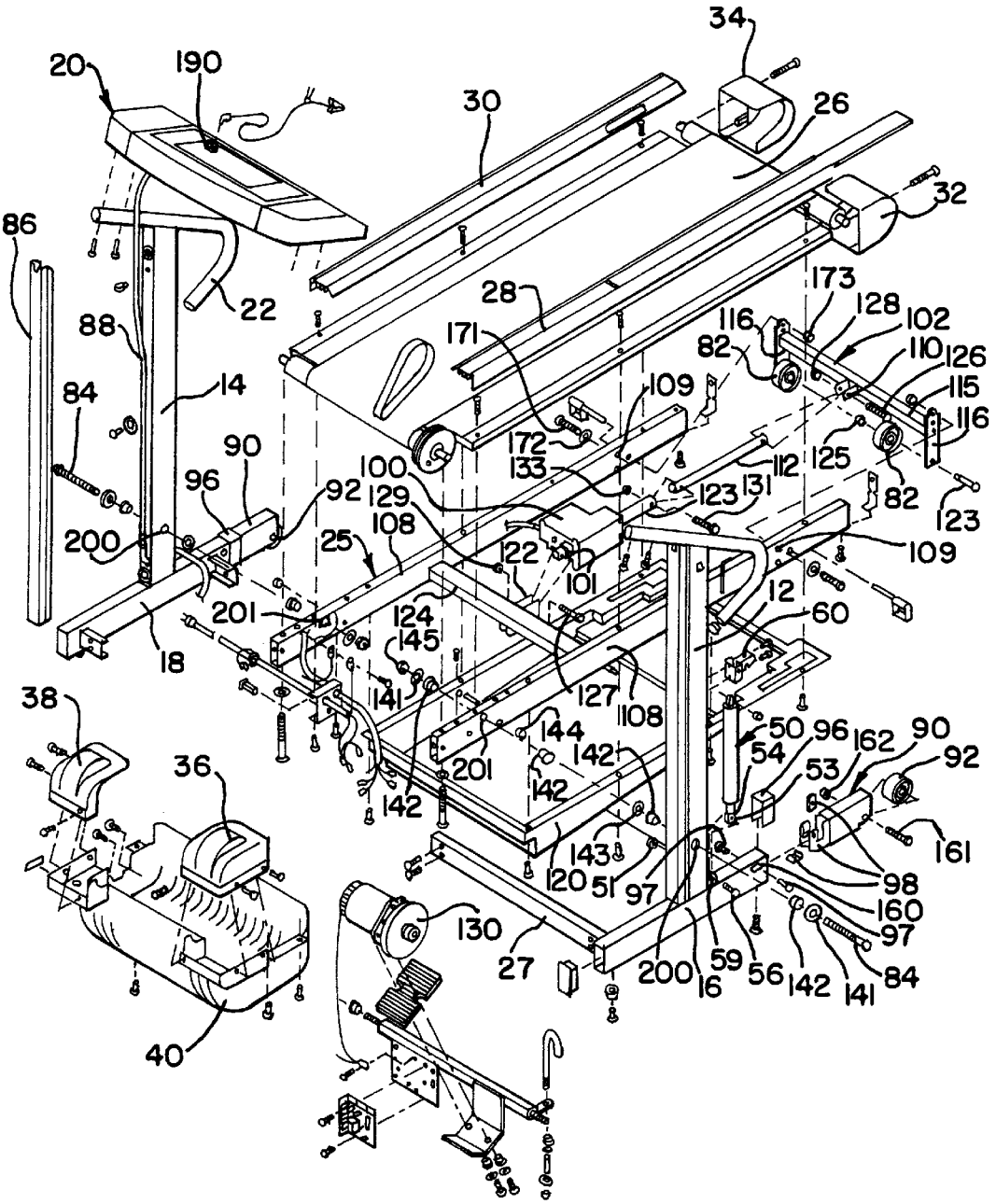
FIG. 8 is an exploded perspective view of an embodiment of the invention.

As shown in FIG. 8, the frame 25 preferably includes two 56 inch frame tubes 108 oriented parallel to each other and separated by a 21 inch frame cross tube 111, which is oriented perpendicular to frame tubes 108. Support bases 16, 18 and legs 12, 14 are also preferably formed of rectangular steel tubing, but any other rigid material may be alternatively used. Support bases 16, 18 have a length of approximately 22 inches, and are oriented parallel to each other and separated by two 2 ft. long cross support bases 27, 29, as shown in FIG. 2.

A gas spring 50 has a gas, preferably nitrogen, filled cylinder 52, and a plunger 54, which is slidably attached to cylinder 52. Fully extended, as shown in FIG. 4, gas spring 50 has a length of approximately 2 ft. Retracted, as shown in FIG. 3, gas spring 50 measures approximately 14 inches. Plunger 54 is rotatably attached to, preferably, an upper surface portion of support base 16, adjacent support leg 12. Preferably, as shown in FIG. 8, the end of plunger 54 has opening 53 which aligns with openings in bracket 59 and is fastened with a bolt and locknut to allow rotation of the gas spring 50 as the track bed 10 is raised and lowered. Cylinder 52 is attached to a side portion of the side rail 28 with rod 58, which is preferably welded to a bottom portion of frame 25, as shown in FIGS. 5–7.

Referring to FIG. 5, an enlarged view of latch 60 is shown interfacing with rod 58. Latch 60 includes a latch head 62 which has a tapered underside 70 to allow the rod 58 to contact with its front end and rotate latch head 62 upward. A bracket 64 has openings which align with opening in a rear portion of the latch head 62. A bolt 66 passes through bracket 64 and latch head openings to allow latch head 62 to partially rotate. Preferably, a compression biased metal spring 68 is positioned within the bracket 64 to bias latch head 62 to a slightly declined position. Metal spring 68 is held in place with sleeve 67, shown in phantom. Alternatively, latch head 62 may preferably interface with gas spring 50 and rod 58, as shown in FIGS. 6–7.

Figure 6:
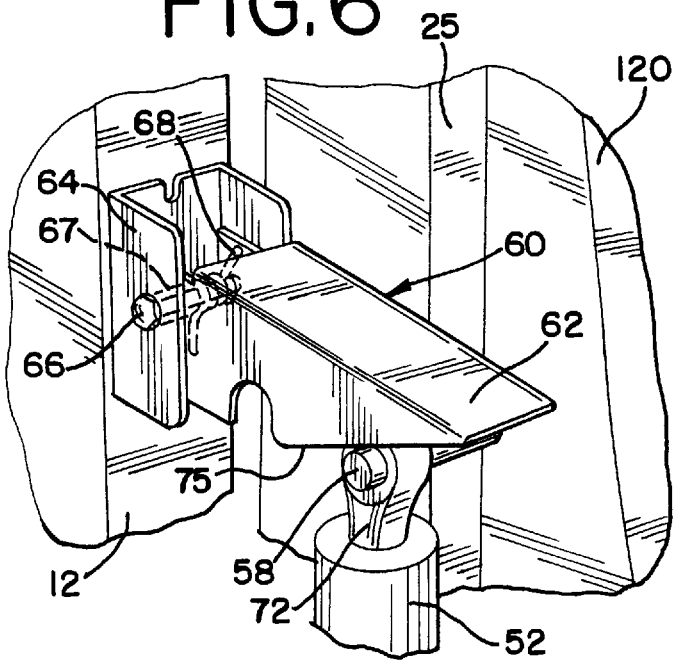
FIG. 6 is an enlarged cut away perspective view of an alternative embodiment of the latch interface with the gas spring and rod in an unlocked position.
Figure 7:
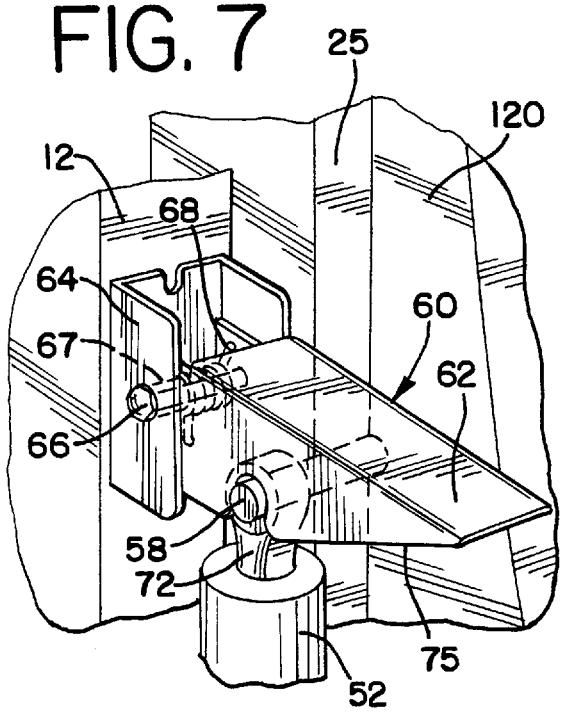
FIG. 7 is an enlarged perspective view of the latch of FIG. 6 in the locked position.

As shown in FIG. 6, as track bed 10 is folded upward, a point is reached, which may vary with the force rating of gas spring 50, where no human contact is necessary to continue the rotation of the track bed 10 to the locked or latched position, as shown in FIG. 7. The automatic latching continues, with rod 58 first contacting the bottom surface of the outermost tip of latch head 62. As track bed 10 continues its rotation to the locked position, rod 58 rides along the tapered bottom surface 75 of latch head 62. The declining angle of the tapered surface 75 forces latch head 62 to rotate upward, which, in turn, further compresses metal spring 68, which is in contact with an upper rear portion of latch head 62. As track bed 10 continues its rotation, rod 58 is received in a notch 74 formed in the sides of latch head 62. This allows spring 68 to force latch head 62 to rotate downward to the locked position.

Track bed 10 will remain securely fastened to support 12 until the user physically lifts up on the front end of latch head 62. Even in the unlatched position, track bed 10 will remain in the up-right position. The user must then pull track bed 10 forward against the force of gas spring 50 to lower track bed 10 to the down position. Depending on the force rating of gas spring 50, which for a preferred embodiment is 160 lbs., track bed 10 may be rotated to a position at least as far as the phantom track bed 80, as shown in FIG. 4, without falling.

Referring to FIGS. 3 and 4, the assist action of gas spring 50 is shown. In the operating or down position, track bed 10 is positioned, as shown in FIG. 3, with track bed 10 contacting the ground at the wheel set 82. To fold track bed 10, the user lifts up on the rear end 195 of track bed 10. The track bed 10 rotates about an axis which runs perpendicular to up-right support legs 12, 14, where a forward end of track bed 10 is rotatably connected to a lower portion of support legs 12, 14. Track bed 10 is rotatably attached to support legs 12, 14 at a point approximately 6 inches from the ground. As shown in FIG. 8, track bed 10 is preferably connected to legs 12, 14 with long hex head bolts 84, washers 141, 143, bushings 142, and locknuts 145 which are inserted through openings 200 in legs 12, 14, that are aligned with openings 201 in the frame 25.

As shown in FIG. 3, in the down position, plunger 54 is substantially enclosed within cylinder 52. This causes the gas, for example, nitrogen, within the cylinder 52 to be further compressed. The compressed cylinder 52 exerts a constant outward force in the direction in which the cylinder is oriented. Even at the down position, gas shock 50 is oriented at an incline to provide a vertical force vector component. As track bed 78 is raised, plunger 54 pushes outward from cylinder 52 until it reaches up-right position as shown in FIG. 4.

Without gas spring 50, the user would experience approximately 30 lbs. of lifting weight when lifting track bed 10 from the down position. With the aid of gas spring 50 (160 lbs. rating), the user experiences only 15 lbs. of lifting weight when raising track bed 10. Alternative designs may include more than one gas spring of a reduced force rating, which equal the rating of gas spring 50. Each of these reduced force springs may be attached to support bases 16, 18, adjacent each of the support legs 12, 14 and to opposite sides of frame 25. Alternatively, longer or shorter gas springs may be used. If a longer gas spring is used, the latch 60 may preferably be positioned at a higher position on the leg 12. Alternatively, with a shorter gas spring, latch 60 could still receive rod 58 which is positioned approximately 26 inches from the ground, for convenient access.

The force rating of a gas spring should be chosen based on, and will vary with the specific configuration and weight of the treadmill. If a gas spring having a greater force rating than necessary is used, the track bed may bounce during use.

An undersized gas spring may be insufficient to prevent the bed from falling rapidly once unlatched. In addition, an undersized spring would provide less assistance for the user when folding the track bed to the up-right folded position.

Referring to FIG. 7, an alternative preferred interface of latch 60 and gas spring 50 is shown in the locked position. In this embodiment, the extended portion 76 of cylinder 52 is positioned directly beneath latch head 62 and is enclosed between the sides of latch head 62. Notch 74 receives rod 58, which extends through an opening in extended portion 76.

Referring to FIG. 8, an exploded view of a preferred embodiment of the treadmill is shown. Support bases 16, 18 include wheel bracket extenders 90. Extenders 90 are made, preferably, of steel or some other rigid material. Extenders 90 are provided as a separate component that must be assembled by the end user by bolting them to the respective support bases 16, 18. Extenders 90 are provided as component parts to allow for a reduced shipping box size. This size reduction allows for many more treadmill boxes per pallet, which drastically reduces shipping costs. By extending the effective length of support bases 16, 18 approximately 6 inches, extenders 90 counteract the force exerted by gas spring 50. Without extenders 90, for the embodiment shown, the entire treadmill would tip over when the user attempts to lower track bed 10. Alternatively, support bases 16, 18, which have a length of approximately 22 inches, could be constructed having a longer length. At the end of extenders 90, wheels 92 are rotatably bolted. When positioning the treadmill, the user may grasp handles 22, 24, with the treadmill in the locked position, and tilt the treadmill so its weight is on wheels 92. From this position the treadmill may be pulled or pushed to a desired location or position.

Also shown in FIG. 8, is an exploded view of an electric incline motor 100, which is attached to frame 25, at bracket 122, which extends from cross tube 124. Movably attached to motor 100 is motor tube 123. An extension tube 112 is formed as a separate component for ease of assembly, but may alternatively be formed as a unitary member with motor tube 123. The tubes 123, 112 preferably are connected through aligned openings in each of the tubes with a bolt 131 and locknut 133. At its other end, extension tube 112 is attached to incline bracket 102. Incline bracket 102 includes, cross bar 115, wheel bracket members 116, and wheels 82. Cross bar 115 and wheel bracket members 116 are preferably made of steel, and the wheels 82 are preferably made of rubber or plastic. Preferably, the attachment of wheels 82 is made through openings in a bracket 110, extending from cross bar 115, and through openings in extension tube 112, with a bolt 126 and locknut 128. Wheel bracket members 116 have openings at both ends for rotatably attaching to frame 25 and to wheels 82. The rotatable attachment to frame 25 is preferably through openings 109 formed in frame tubes 108 and opening formed in wheel bracket members 116 with a bolt 171, washer 172 and locknut 173. Wheels 82 are rotatably attached through openings formed at the opposite end of wheel bracket members 116, with preferably a bolt 123 and capnut 125. When incline bracket 102 is in the fully extend position, wheel bracket members 116 are generally perpendicular to frame tubes 108, and wheels 82 are approximately 4.5 inches from the bottom surface of frame 25. This provides the user, a near horizontal running surface, although preferably, track bed 10 remains at a slight incline even when wheels 82 are fully extended. When wheels 82 are fully retracted, they remain partially extended from frame cover 120 and are the only contact points with the ground, at the rear end of the track bed 10.

Incline motor 100 is activated at console 20 by depressing an incline switch 190, which is electrically connected to incline motor 100 with control wiring 88. For efficient manufacturing assembly, control wires 88 are run along a side of support leg 14, and a support cover 86 is snap-fitted onto the support leg to conceal the wiring 88.

When activated to extend wheels 82, incline motor 100 will retract the extension tube 112 in a direction toward the forward end of the treadmill. This causes incline bracket 102 to rotate about an axis which coincides with the rotatable connection points of wheel bracket members 116 and frame tubes 108. The motor will automatically deactivate when wheel bracket members 116 are approximately perpendicular to the frame 25. To provide a steeper incline, wheels 82 may be retracted. To retract wheels 82, incline motor 100 reverses the direction of motor tube 123, thus forcing the extension tube 112 toward the rear end 195 of the treadmill. This action, in turn, reverses the rotation of incline bracket 102, and rotates wheels 82 to a partially concealed position within frame cover 120.

Figure 10:
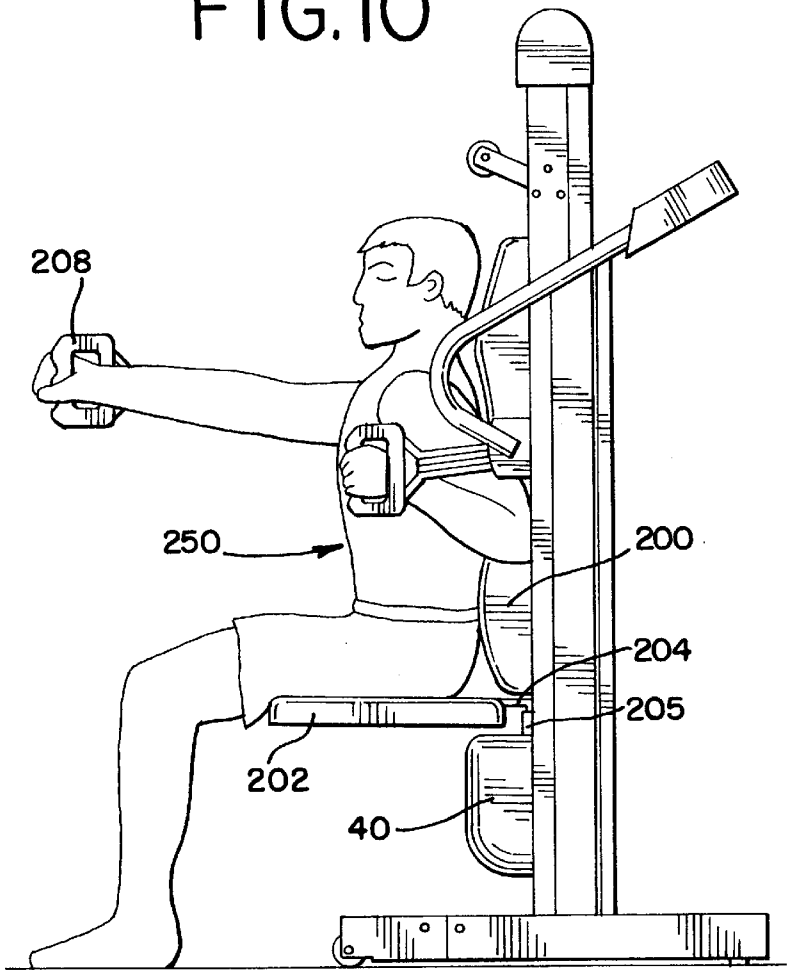
FIG. 10 is a side elevational view of the embodiment of FIG. 9 showing a user positioned on the bench and engaging the exercise bands.
Figure 9:
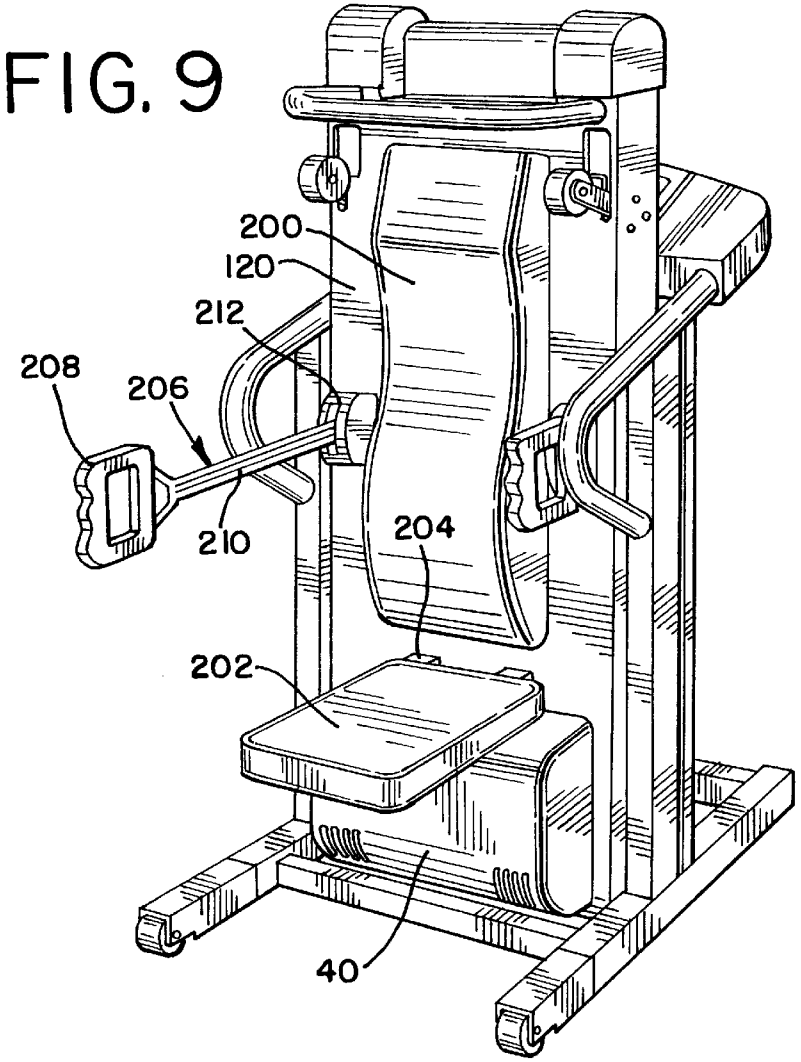
FIG. 9 is a perspective view of an embodiment of the invention including bench and bed mounted exercise band system.

Referring to FIGS. 9 and 10, an alternative embodiment is shown having bench seat 202 which is removably attached to the frame 25. Preferably the bench seat 202 has rigid connectors 204 that are received in a rigid receiving portion 205 which is located adjacent the motor housing 40 as shown in FIG. 10. When the treadmill is in the up-right closed position, the user can quickly insert the rigid connectors 204 through the opening formed in the receiving portion 205, and quickly remove the bench seat 202 when the upper body work-out is completed. A backrest 200 provides the user 250 resistance while exercising. Preferably the backrest 200 is ergonomically curved to position the user 250 in the proper position for performing bench press and other upper body exercises. Preferably, the backrest 200 may be formed of plastic, and may be formed as a raised portion of the frame cover 120. Attached to the frame 25, are mounts 212. The mounts 212 are preferably formed from a rigid material and have an opening for receiving the retracted band portion 210 of the exercise bands 206. Each of the exercise bands 206 include handles 208 for allowing the user 250 to grab and extend the bands, as shown in FIG. 10. The mounts 212 are secured to the frame cover 120, or formed as a raised portion of the frame cover 120. The mounts 212 have openings designed to allow the user to extend the bands at various angles. Preferably, the end of the band portion 210 is secured to the mount 212, within the opening. While not in use the bands retract within the mounts 212. Any conventional cam mechanism may be used to retract the bands 206 within the mounts 212. The track bed may then be lowered without damaging the exercise bands 206. Alternatively, a pulley resistance system or other conventional exercise apparatus may be used in place of the exercise bands.

Figure 12:
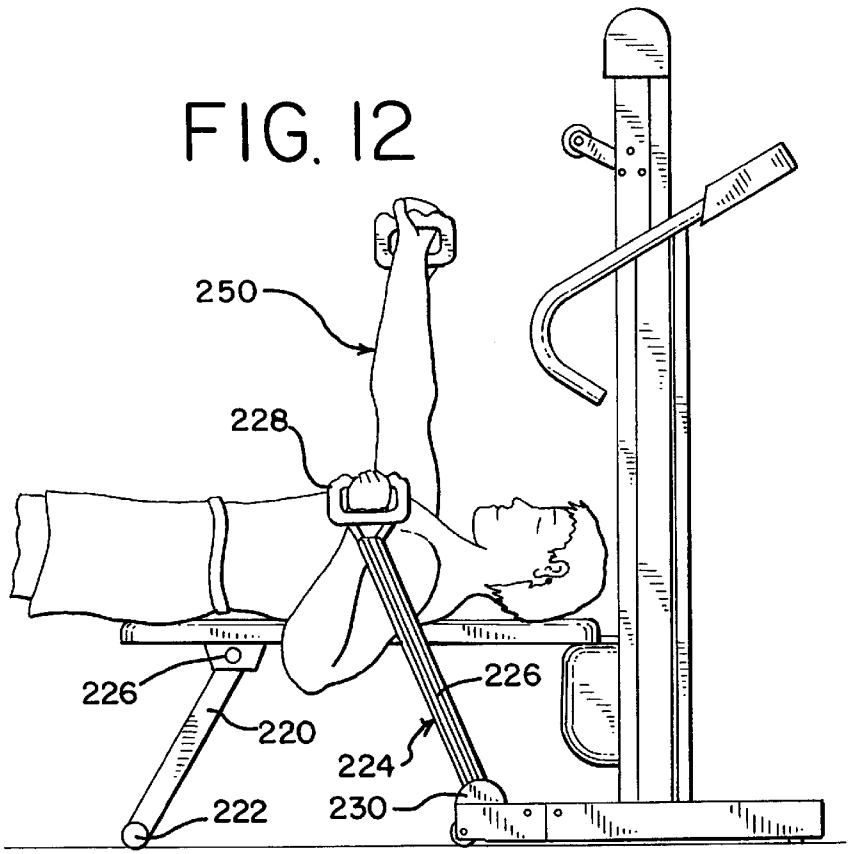
FIG. 12 is a side elevational view of the embodiment of FIG. 11 showing a user positioned on the bench and engaging the exercise bands.
Figure 11:
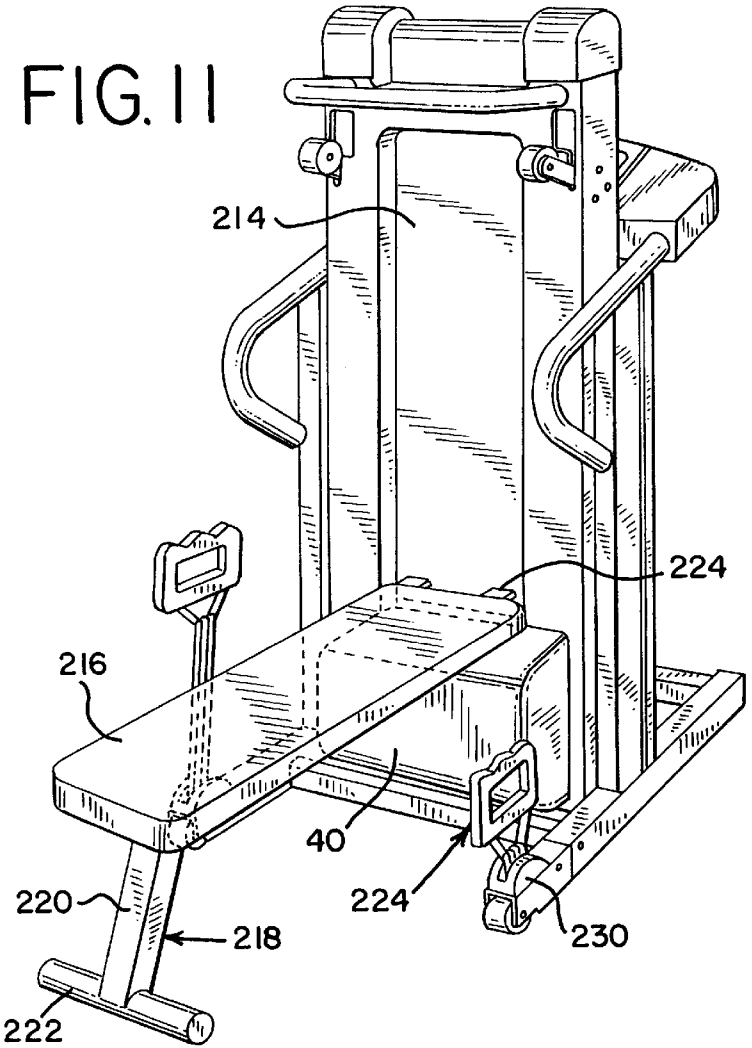
FIG. 11 is a perspective view of an embodiment of the invention including foldable bench and support mounted exercise band system.

Referring to FIGS. 11 and 12, an alternative embodiment is shown having a fold-up bench 216 and support mounted exercise bands 224. The bench 216 is preferably hinged to the frame 25 and/or frame cover 120, and may be supported by the top portion of the motor housing 40. The frame cover 120 has a recessed area 214 to receive the bench 216. Bench leg 220 is foldably attached to the bench 216 to provide further support. Preferably the leg is foldably attached to a rear end of the bench with a fastener 226. The leg preferably has feet 222 to provide further stability. When not in use, the bench may be folded into the recessed area 214 and the leg 220 may be folded down upon the bottom side of the bench 216. The recessed area 214 is designed to form fit with the bench 216 so that the bench will remain within the recess and while not in use. Alternatively the bench 216 may be latched to the frame cover 120.

As shown in FIGS. 11 and 12, The support mounted exercise bands 224 include a handle 228 and elastic band 226. The elastic bands are secured at one end to the support mounts 230, which have openings to receive the retracted bands 226. In operation, the user would fold out the bench leg 220 and rotate the bench 216 so that the feet 222 are on the floor. At this point, the bench is substantially perpendicular to the track bed and supported at the forward end by the motor housing 40 and at the back end by the leg 220. The user may then lay down on the bench and grasp the handles 228. A variety of exercises may be performed including bench press. The user may also sit on the bench to perform other exercises including military press, curls, etc.

The benches 202, 216 are designed, to support the user when using free weights. Alternatively the benches 202, 216 may be removed to allow the user to exercise with the exercise bands from various positions, including standing and crouching, etc. Alternatively, the benches 202, 216 may be removed, and the user may use a stand alone bench or other support apparatus and utilize the exercise bands.

Figure 13:
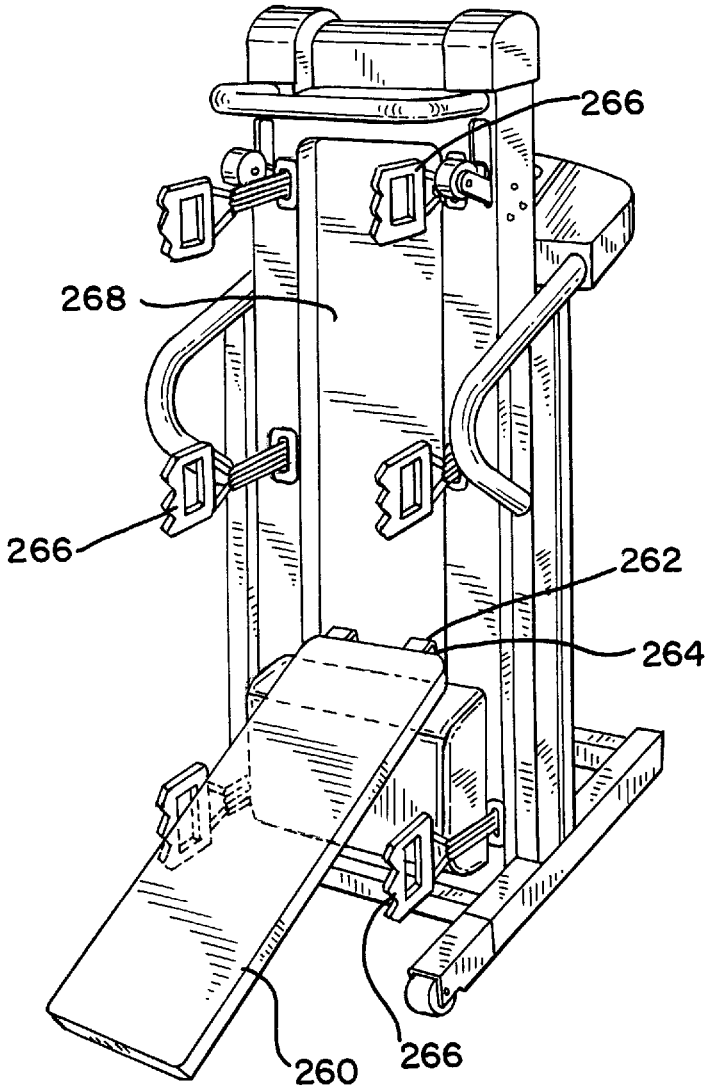
FIG. 13 is a perspective view of an alternative embodiment having a slant board and multiple exercise bands.

As shown, in the embodiment of FIG. 13, the bench may include a slant board 260 that is attached to the track bed with connectors 262 that are received in openings 264 on the underside of the track bed. Multiple exercise bands 266 may be mounted to and positioned along the track bed frame 25 to provide the user with multiple angles for exercising the upper body. The bench or slant board 260 may be rotated and folded into the recessed area 268, or removed from the treadmill. In general, the exercise bands may also be used without the slant board or bench, or may be used with any conventional stand alone support.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. A method of operating a treadmill apparatus comprising:

providing a folding treadmill with a track bed in an up-right position and with a bench folded into an underside of the track bed; and folding down the bench which is rotatably connected to the track bed.

2. The method of claim 1 further comprising:

providing exercise bands mounted on a base support; and pulling the bands while positioned on the bench.

3. A method of operating treadmill apparatus comprising:

providing a folding treadmill including a track bed in an upright position and a bench; and attaching the bench to a receiving portion formed in an underside of the track bed.

4. The method of claim 2 further comprising:

providing exercise bands mounted to an underside of the track bed; and pulling the exercise bands while positioned on the bench.

5. Treadmill apparatus comprising:

a support;

a track bed rotatably attached to the support; and at least one exercise band attached to an underside of the track bed.

6. The treadmill apparatus of claim 5 further comprising a bench attached to the track bed.

7. The treadmill apparatus of claim 5 further comprising a back rest attached to the track bed.

8. A treadmill apparatus comprising:

an up-right support;

a track bed; and a bench attached to an underside of the track bed, the underside of the track bed including a recessed area to receive the bench.

9. The treadmill apparatus of claim 5, wherein the track bed is rotatably attached to the upright support to allow the track bed to be positioned in an upright folded position or a down operating position.

10. The treadmill apparatus of claim 9, wherein the bench is rotatably attached to the track bed.

11. The treadmill apparatus of claim 9, further comprising a spring attached at a first end to the upright support and at a second end to the track bed.

12. The treadmill apparatus of claim 11, wherein the spring is a gas spring.

13. The treadmill apparatus of claim 11, wherein the first end of the spring is attached to a base support extending from the upright support.

14. A treadmill apparatus comprising:

an upright support;

a track bed; and a bench attached to an underside of the track bed, at least one exercise band mounted to the underside of the track bed.

15. The treadmill apparatus of claim 14, wherein the track bed is rotatably attached to the upright support to allow the track bed to be positioned in a up-right folded position or a down operating position.

16. The treadmill apparatus of claim 14, wherein the bench is rotatably attached to the track bed.

17. The treadmill apparatus of claim 15, further comprising a spring attached at a first end to the upright support and at a second end to the track bed.

18. The treadmill apparatus of claim 17, wherein the spring is a gas spring.

19. The treadmill apparatus of claim 17, wherein the first end of the spring is attached to a base support extending from the upright support.

20. A treadmill apparatus comprising:

an upright support;

a track bed; and a bench attached to an underside of the track bed, the underside of the track bed including a back support.

21. The treadmill apparatus of claim 20, wherein the track bed is rotatably attached to the upright support to allow the track bed to be positioned in an upright folded position or a down operating position.

22. The treadmill apparatus of claim 21, wherein the bench is rotatably attached to the track bed.

23. The treadmill apparatus of claim 21, further comprising a spring attached at a first end to the upright support and at a second end to the track bed.

24. The treadmill apparatus of claim 23, wherein the spring is a gas spring.

25. The treadmill apparatus of claim 21, wherein the first end of the spring is attached to a base support extending from the upright support.

* * * * *

UNITED STATES PATENT AND TRADEMARK OFFICE

CERTIFICATE OF CORRECTION

PATENT NO. : 5,830,113
DATED : November 3, 1998
INVENTOR(S) : Bruce F. Coody et al.

It is certified that error appears in the above-identified patent and that said Letters Patent is hereby corrected as shown below:

Title page,
Page 1, column 2,
Second cite under "OTHER PUBLICATIONS", please change "and The Step II (Sears The Great American Wish Book 1991, 2 pp.)." to -- and "The Step II" (Sears "The Great American Wish Book" 1991, 2 pp.).

Page 3, column 2,
Line 23, under "OTHER PUBLICATIONS", please add before "." (period) -- (Vitamaster Industries, Inc., 1988, 10 pp.) --.

Claim 9,
Line 1, please change "claim 5," to -- claim 8, --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*